US005634703A

United States Patent [19]

Vonier

[11] Patent Number: 5,634,703

[45] Date of Patent: Jun. 3, 1997

[54] DRAWER GUIDE FOR PULL-OUT COMPONENTS OF FURNITURE

[75] Inventor: Stefan Vonier, Schruns, Austria

[73] Assignee: Fulterer Gesellschaft m.b.H., Schruns, Austria

[21] Appl. No.: 533,221

[22] Filed: Sep. 25, 1995

[30] Foreign Application Priority Data

Oct. 5, 1994 [AT] Austria ..... 1887/94

[51] Int. Cl.[6] ..... A47B 88/14

[52] U.S. Cl. ..... 312/334.12; 348/19; 348/21; 312/330.1; 312/333; 312/334.44; 312/334.46

[58] Field of Search ..... 312/330.1, 333, 312/334.7, 334.12, 334.44, 334.45, 334.46; 348/19, 21

[56] References Cited

FOREIGN PATENT DOCUMENTS 372829 11/1983 Austria .

*Primary Examiner*—Peter M. Cuomo

*Assistant Examiner*—Stephen Vu

*Attorney, Agent, or Firm*—Anderson, Kill & Olick P.C.

[57] ABSTRACT

A drawer guide for a pull-out component of a piece of furniture includes a carcass rail fixedly attachable to an inner side of the piece of furniture, a support rail for supporting the pull-out component, a middle rail arranged between the carcass and support rails and having at least two, arranged one above another, horizontal flanges which serve as tracks for a plurality of freely rotatable rollers, and at least one stop provided between the middle and support rails for limiting a pull-out path therebetween and projecting through a recess formed in the lower one of the two flanges, with the stop cooperating with a track roller provided on the rear end of the support rail.

9 Claims, 3 Drawing Sheets

DRAWER GUIDE FOR PULL-OUT COMPONENTS OF FURNITURE

BACKGROUND OF THE INVENTION

The present invention relates to a drawer guide for a pull-out component of a piece of furniture, which includes a carcass rail fixedly attachable to an inner side of the piece of furniture and having a substantially C-shaped cross-section, a support rail for supporting the pull-out component, a substantially S-shaped middle rail arranged between the carcass and support rails and having at least two, arranged one above another, horizontal flanges which serve as tracks, a plurality of freely rotatable rollers provided on the two horizontal flanges, and a stop provided between the middle and support rails, with one of the plurality of rollers being arranged at a rear end of the support rail and with the stop cooperating with the one roller for limiting a pull-out path between the middle and support rails.

Drawer guides of the above-described type are known (see, e.g., Austrian Patent No. 372,829). Such a drawer guide proved to be a particularly useful for heavily loaded drawers. A particular problem, associated with such drawer guides, consists in shaping of stops which limit the pull-out path of the support rail with respect to the middle rail. The support rail, before it is mounted in the guide, need be secured to the drawer. As a result, for mounting of the drawer on the carcass and middle rails, which are already mounted in the furniture body, one more displacement plane is needed, namely, a vertical plane. Only in this vertical plane, the support rail can be pivoted for mounting the drawer on the already mounted guide parts. However the pivot angle, which is available in this type of guides, is rather limited. That means that a stop, which is provided on the support rail for limiting the pull-out displacement, should be provided not only near the upper horizontal flange of the support rail but should also have, in addition, only a small height. Furthermore, the stop should be made releasable and replaceable to enable its easy replacement in case the support rail, together with the drawer, could not be mounted. All this complicates the shaping and manufacturing of the stop, which makes it rather expensive. The requirement that the stop be mounted high on the support rail and, thus, have a relatively small height results in that the stop easily overruns the front track roller or the support roller of the middle rail, especially, when the drawer is heavily loaded, and the pull-out is effected with so-called "leap." In such drawer guides, the stop instead of abutting the front track or support roller provided on the middle rail and, thus, ending the pull-out displacement of the support rail, the stop leaps, because of its particular construction, over the roller provided on the middle rail, and the support rail moves, further, without being braked, until it falls on the floor, unless the displacement of the support rail is not stopped by some other means. The failure to stop the displacement of the support rail can result in a damage of a drawer and the drawer unit, and this can lead to an injury of anybody close to the furniture. To avoid this drawback, it was proposed to mount the stop on the lower flange of the middle rail of the above-described drawer guide with a possibility of a sidewise swinging out (Austrian Patent No. 372,829). To this end, the stop was mounted with a possibility to pivot about an axis extending vertically to the flange plane. However, to effect such a stop mounting, providing of a pivot axis became necessary which increases the mounting costs not insubstantially. Further, for the stop to be able to pivot or swing out sidewise, a vertical web of the stop carrying flange should be cut out adjacent to the stop. The size of the cut-out should be relatively large to provide for free and unhindered displacement of the stop. This results in weakening of a substantial portion of the load-carrying web of the rail.

To eliminate the above-discussed drawback, it was proposed to provide a locking bar in the end region of the middle rail. This locking bar reduced the gap between the bottom of the middle horizontal flange of the middle rail and the upper side of the upper horizontal flange of the support rail. In this way, the support rail was prevented from lifting off of the support roller of the middle rail when the stop, which limits the pull-out path of the support rail, run on the support roller, whereby the stop could not overrun the support roller. However, the projecting locking bar forms a separate part which should be fixedly attached to the middle rail after mounting of the support rail on the middle rail. Because of this, the support rail or the drawer can be dismounted and removed from the guide only after the removal of the locking bar. Besides this locking bar can easily be lost. Moreover, any additional part which need be manufactured and mounted increases the costs of the assembly.

An Austrian patent No. 393,781, which corresponds to U.S. Pat. No. 4,938,609, discloses providing, above the stop, of a slide in a slot of the horizontal flange of the support rail for preventing lifting off of the support rail of the support roller of the middle rail. This slide reduces the gap between the bottom of the middle horizontal flange of the middle rail and the upper side or surface of the supper horizontal flange of the support rail. At that, the edge portions project into the grooves, which are provided in the slide, whereby the slide is able to move along the flange in an axial direction of the rail. This slide adequately performs its designed function, however, the access to it is rather difficult, with a portion of a slide being almost completely unaccessible, in particular in roll-top desks, where the drawer guides are covered with side aprons.

Accordingly, an object of the invention is to provide in a drawer guide of the above-discussed type, in particular in a drawer guide similar to that disclosed in Austrian patent No. 372,829, a stop which would have a size sufficient to prevent the track roller of the support rail from overrunning the stop even when the support rail or the drawer, which is carried thereon, is sharply pulled out and which, at the same time, can be easily mounted.

Another object of the invention is to provide a relatively large stop for which weakening of the vertical web of the rail by a cut-out would not be needed.

SUMMARY OF THE INVENTION

These and other objects of the invention, which will become apparent further below, are achieved by providing a stop which projects through a recess, formed in a lower horizontal flange of the middle rail, is able to sink beneath the plane of this flange, and is supported on a strut which is formed of an elastically deformable material, extends in a longitudinal direction of the rails, and has one end thereof supported on the lower horizontal flange.

According to the invention, it is further contemplated to form the surface of the stop, which is located more closely to the front end of the middle rail, inclined to give the stop a wedge-like shape, with the stop surface of the stop having a profile corresponding to the circumference of the track roller. With such a stop, during the insert of the support rail, the track roller is displaced along the inclined surface of the stop, displacing the stop downwardly, and the track roller is able to overrun the stop, without any additional manual action. On the other hand, the stop surface of the stop, because of its profile, prevents the track roller from overrunning the stop when the support rail moves in the pull-out direction. To more reliably insure the stop function of the stop, the height of the stop is made substantially equal to the radium of the track roller.

If the stop need be mechanically secured in its position, it is contemplated to form the stop as a hook-like member which engages a side edge of the recess through which the stop projects, with the stop supporting strut being mounted with a possibility of displacement in the longitudinal direction of the rails. The displacement of the stop or the strut in the longitudinal direction and the form-locking mounting of the stop on the flange, which is achieved thereby, prevents the stop from deflection.

It is particularly easy to mount the stop when the stop supporting strut has, at its end remote from the stop, a mushroom-like, upwardly projecting boss which extends through a slot-like recess, formed in the lower flange of the middle rail, and the length of which corresponds at least to the displacement path of the stop. Upon being pressed into the slot-like recess, the boss is fixedly held therein due to its mushroom shape. The mounting of the strut is easily effected manually, without requiring a significant force.

If the slot-like recess, which receives the mushroom-like boss, is narrowed in its middle portion to form a detent, then both end positions of the displacement path are precisely defined, and the strut is form-lockingly retained in both end positions.

To prevent the boss portion, which projects above the flange surface, from blocking the displacement path of the track roller of the support rail during the insertion and pull-out of the drawer, it is further contemplated to locate the slot-like recess in front of the recess, through which the stop projects, in the insertion direction.

It is further contemplate to form the stop, the strut and the mushroom-like boss as a one-piece member from an elastically deformable material.

Because the boss projects above the track-serving flange, it is contemplated to provide above the slot-like recess in the middle horizontal flange of the middle rail, a recess adapted to partially receive the track roller, which is provided on the rear end of the support rail when the roller overruns the boss.

BRIEF DESCRIPTION OF THE DRAWINGS

The features and objects of the present invention will become more apparent, and the invention itself will be best understood from the following detailed description of the preferred embodiments when read with reference to the accompanying drawings, wherein.

DETAILED DESCRIPTION OF THE PREFERRED EMBODIMENTS

Figure 1:
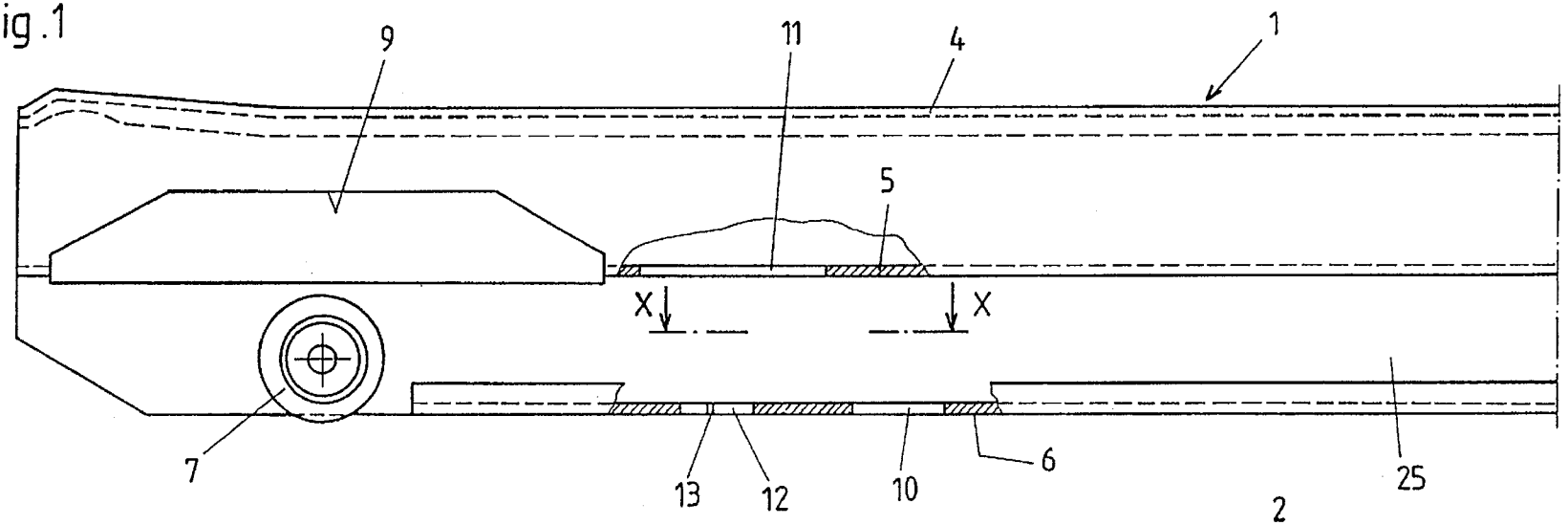
FIG. 1 shows a middle rail of a three-rail drawer guide according to the present invention.

FIG. 1 shows a side view of a front section of the middle rail 1 of a three-rail drawer guide according to the present invention. The guide further includes a carcass rail 2 and a support rail 3 for supporting the pull-out drawer. The carcass rail 2 has a substantially C-shaped cross-section.

The S-shaped middle rail 1 has an upper horizontal flange 4, an intermediate horizontal flange 5 and a lower horizontal flange 6. A freely rotatable support roller 7 is mounted on a lower vertical web 25 at the front portion of the middle rail 1. The support roller 7 supports a horizontal flange 8 of the support rail 3. A peripherally closed recess 9 is provided above the support roller 7. However, there exists guides in which the recess above the support rail is open toward the front. The horizontal flanges 4, 5, 6 of the middle rail 1 serve as tracks for the track or rail rollers 15 and 24.

Figure 10:
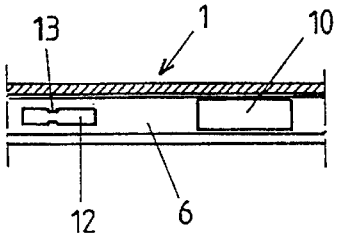
FIG. 10 shows a detail of the middle rail designated in FIG. 1 with a line X—X.

As can be seen in FIG. 1 and in more detail in FIG. 10, a substantially rectangular recess 10 and a slot-like recess 12 are provided in the horizontal lower flange 6 in the region beneath the support roller 7. The reduced middle portion of the recess 12 forms a detent 13.

Figure 3:
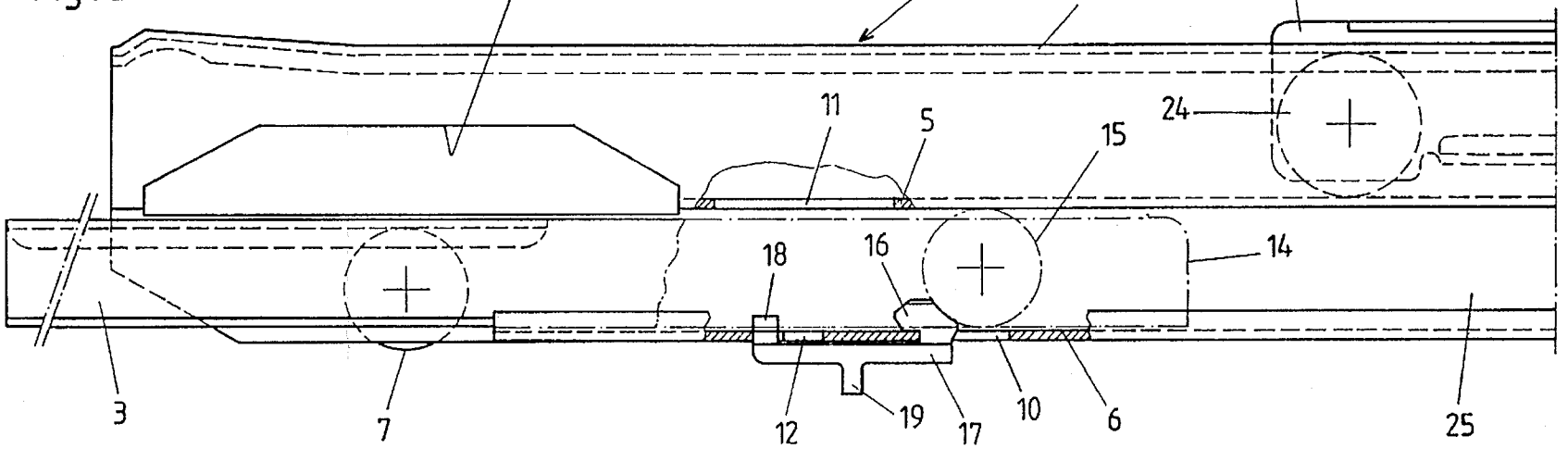
FIG. 3 shows a side view of the drawer guide shown in FIG. 2, with a support rail abutting the middle rail.
Figure 2:
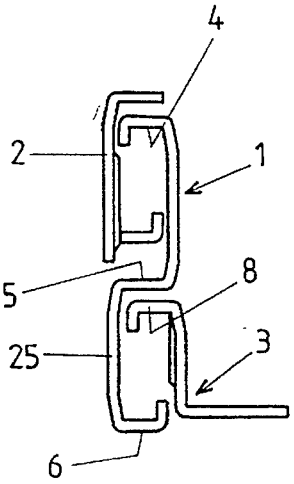
FIG. 2 shows a plan view of the drawer guide.
Figure 6:
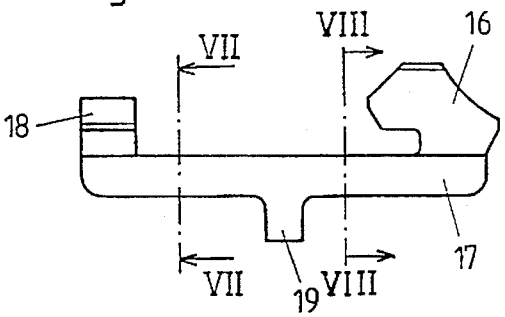
FIG. 6 shows a side view of the track roller stop.
Figure 7:
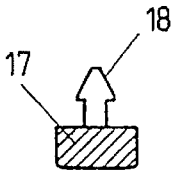
FIG. 7 shows a cross-sectional view along line VII—VII in FIG. 6.
Figure 9:
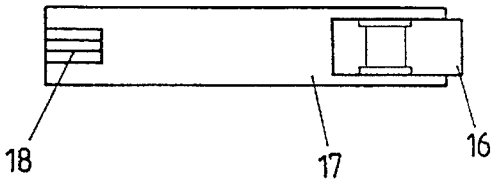
FIG. 9 shows a plan view of the track roller stop.
Figure 8:
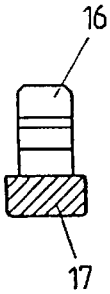
FIG. 8 shows a cross-sectional view along line VIII—VIII in FIG. 6.
Figure 4:
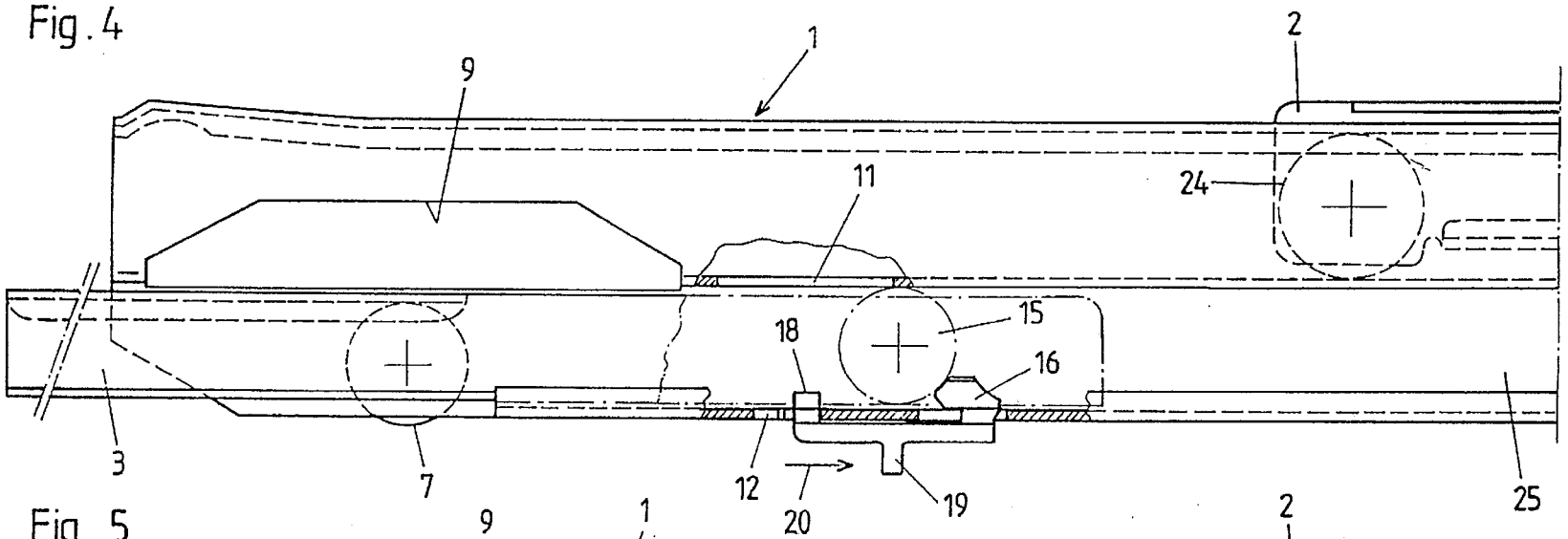
FIGS. 4 and 5 show each view similar to that of FIG. 3 but with a track roller stop in a different position.
Figure 5:
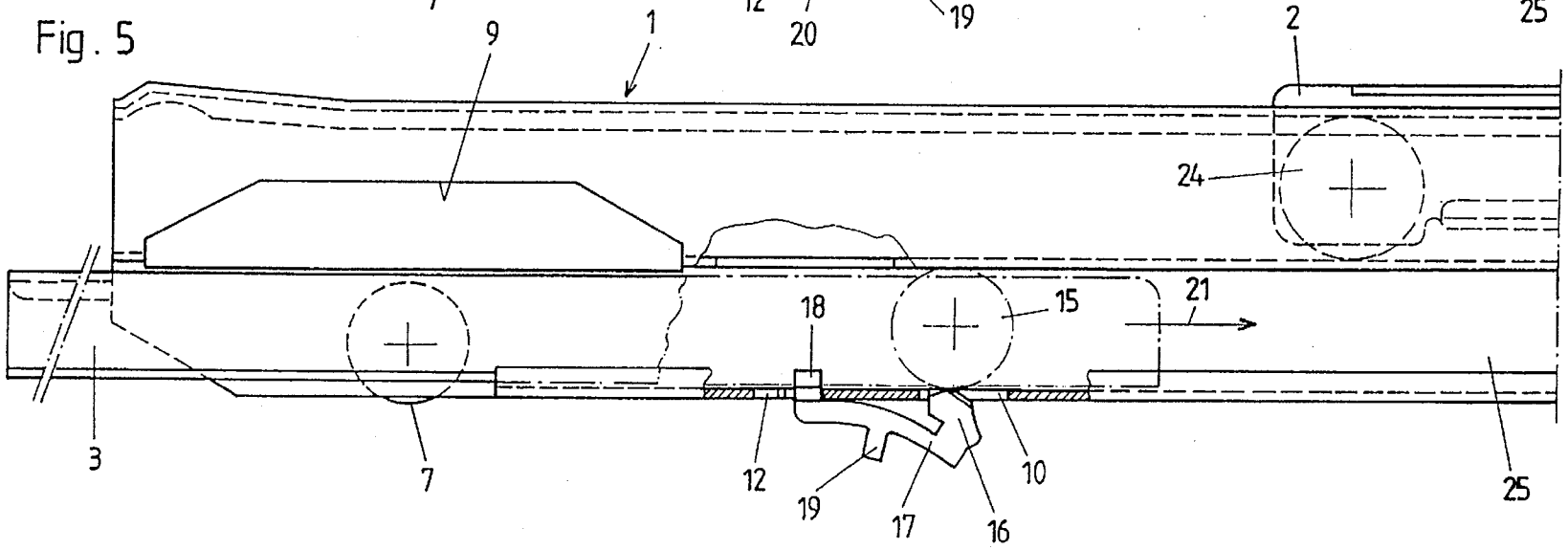

In FIGS. 3–5, the rear portion of the support rail 3 is broken off, as shown by a dot-dash line. This is done to more clearly show the features which are essential for the present invention. In this rear portion of the support rail 3, there is provided a track roller 15 which, upon displacement of the drawer, rolls along the horizontal flanges 5 and 6 of the middle rail 1. The stop 16, which cooperates with the roller 15 of the support rail 3 and limits the pull-out path of the support rail 3 with respect to the middle rail 1. The stop 16 has, as shown in FIG. 6, a hook-like shape. The stop 16 is a part of a strut 17 which carries on one of its ends a mushroom-like boss 18. A small gripping projection 19 is provided on the bottom of the strut 17. Generally, the parts 16–19 are formed of an elastically deformable material as a one-piece member.

The arrangement of this one-piece, elastically deformable member on the middle rail 1 is shown in FIG. 3. The mushroom boss 18 is received in a slot-like recess 12 and is arranged in the portion of the slot 12 which is adjacent to the support roll 7. The strut 17 lies on the bottom of the horizontal flange 6 of the middle rail 1, and the hook-shaped stop 16 engages a side edge of the recess 10 through which the stop 16 projects. As can be seen in FIG. 3, the stop 16 has relatively large dimensions, so that it cannot be overrun by the track roller 15 if a sharp displacement of the load or the drawer takes place. A further recess 11 is provided above the slot-like recess 12 in the middle horizontal flange 5 of the middle rail 1.

FIG. 3 shows the position of the stop 16 in the recess 10 during normal operational use of the drawer guide. During mounting of the drawer or the above-described drawer guide, first, the carcass rail 2 is attached to the inner side of the furniture piece. Then, the middle rail 1 is inserted and then, the drawer, together with the support rail 3 is inserted from the front. This process is shown in FIGS. 4 and 5, where it is shown in FIGS. 4 and 5, where it is shown that the track roller 15 of the support rail 3 is already located behind the support roller 7 of the middle rail 1.

During this process, the stop 16 is pushed, by acting on the gripping projection 19, backward, as shown by arrow 20, and FIG. 4 shows a position in which the hook-like stop 16 does not engage the side edge of the recess 10 anymore. The track roller 15 overruns for a moment a portion of the mushroom-like boss 18, which projects inward, and is able to project somewhat upward through the recess 11. Then, the roller 15 again abuts the pushed-back stop 16 which, due to its elasticity, is displaced downward (please see FIG. 5). As soon as the pushed downward stop 16 is released by the displaceable roller, it again pivots upward in a direction indicated by arrow 21 and is pulled towards the support roller 7 by an acting on the gripping projection 19 until the stop 16 occupies its initial position shown in FIG. 3 in which the stop 16 form-lockingly engages the side edge of the recess 10 and forms an obstacle for the roller 15 of the support rail 3, which obstacle the track roller 15 cannot overcome. When the drawer has to be pulled out, the stop 16 is pushed backward and downward so that the drawer can be pull out.

Figure 11:
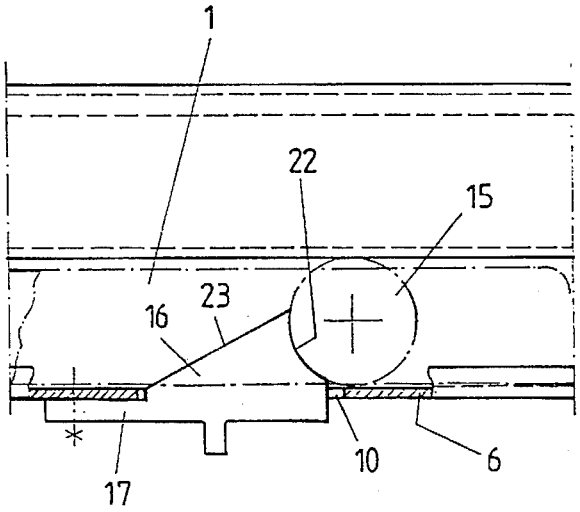
FIG. 11 shows a detail of another embodiment of a drawer guide according to the present invention.

FIG. 11 shows a simplified structure of the guide according to the present invention. The view of FIG. 11 substantially corresponds to that of FIG. 3. In the embodiment of FIG. 11, the stop 16 is displaced not horizontally but rather downward relative to the horizontal flange 6 of the middle rail 1. In the embodiment of FIG. 11, the stop 16 has a relatively large height, and the stop surface 22, which is engaged by the roller 15, has a profile complementary to the circumference of the roller 15, with the stop height being equal at least half of the roller diameter, so that the roller 15, upon abutting the stop surface 22, does not displace the stop 16 downward. The surface 23, which is inclined toward the support roller 7 and the front side, forming a wedge-shaped profile along which the track roller 15 can be displaced. With the track roller 15 movable along the surface 23, the stop 16 is displaced downward through the recess 10, eliminating an obstacle for the displacement of the track roller 15 along the flange 6. Due to the elasticity of the material from which the stop 16 and the strut 17 is formed, the stop 16 pivots upward, as soon as it is overrun by the track roller 15, in its position shown in FIG. 11. Further, instead of the gripping projection 19 shown in the drawings, the bottom of the strut 17 can be furrowed.

Providing the stop 16 on the lower horizontal flange 6 of the middle rail 1 make it easily accessible even when the drawer guide is completely covered with a side screen, as it is usually the case in roll-top desks.

Though the present invention was shown and described with reference to the preferred embodiments, various modifications thereof will be apparent to those skilled in the art and, therefore, it is not intended that the invention be limited to the disclosed embodiments or details thereof, and departure can be made therefrom within the spirit and scope of the appended claims.

What is claimed is:

1. A drawer guide for a pull-out component of a piece of furniture comprising:

a carcass rail fixedly attachable to an inner side of the piece of furniture and having a substantially C-shaped cross-section;

a support rail for supporting the pull-out component;

a substantially S-shaped middle rail arranged between said carcass and support rails and having at least two, arranged one above another, horizontal flanges which serve as tracks;

a plurality of freely rotatable rollers provided on said at least two horizontal flanges; and at least one stop provided between said middle and support rails for limiting a pull-out path therebetween, wherein one of the plurality of freely rotatable rollers is arranged at a rear end of said support rail, said stop cooperating with said one of the plurality of rollers for limiting the pull-out path;

wherein said stop projects through a recess formed in a lower one of said at least two horizontal flanges and is fixedly attached to an elongate strut, which is formed of an elastically deformable material, extends in a longitudinal direction of said rails and has one end thereof arranged on said lower one of said at least two flanges, whereby said stop can be lowered beneath a plane of said lower one of said at least two horizontal flanges.

2. A drawer guide as set forth in claim 1, wherein a surface of the stop 16, which is adjacent to a front end of the middle rail, defines a wedge-shaped profile, and a stop surface of the stop has a profile complementary to a circumference of said one of the plurality of rollers.

3. A drawer guide as set forth in claim 2, wherein said stop has a height approximately equal to a radius of said one of the plurality of rollers.

4. A drawer guide as set forth in claim 1, wherein said stop has a hook-shape portion which engages a side edge of the recess formed in the lower one of said at least two horizontal flanges, and wherein said strut comprises means for enabling displacement of said strut in the longitudinal direction.

5. A drawer guide as set forth in claim 4, wherein said slot-shape recess is located in front of the recess, through which said stop projects, when viewed in a pull-out direction.

6. A drawer guide for a pull-out component of a piece of furniture comprising:

a carcass rail fixedly attachable to an inner side of the piece of furniture and having a substantially C-shaped cross-section;

a support rail for supporting the pull-out component;

a substantially S-shaped middle rail arranged between said carcass and support rails and having at least two, arranged one above another, horizontal flanges which serve as tracks;

a plurality of freely rotatable rollers provided on said at least two horizontal flanges; and at least one stop provided between said middle and support rails for limiting a pull-out path therebetween, wherein one of the plurality of freely rotatable rollers is arranged at a rear end of said support rail, said stop cooperating with said one of the plurality of rollers for limiting the pull-out path;

wherein said stop projects through a recess formed in a lower one of said at least two horizontal flanges and is fixedly attached to a strut, which is formed of an elastically deformable material, extends in a longitudinal direction of said rails and has one end thereof arranged on said lower one of said at least two horizontal flanges, whereby said stop can be lowered beneath a plane of said lower flange;

wherein said stop has a hook-shaped portion which engages a side edge of the recess formed in the lower one of said at least two horizontal flanges, and wherein said strut comprises means for enabling displacement of said strut in the longitudinal direction; and wherein the strut has at an end thereof remote from the stop a mushroom shaped, upwardly projecting boss which extends through a slot shaped recess formed in said lower one of said at least two flanges and which has an axial length corresponding at least to a displacement path of said stop.

7. A drawer guide as set forth in claim 6, wherein said slot-shape recess has a narrow middle portion to form a detent.

8. A drawer guide as set forth in claim 6, wherein another one of said at least two horizontal flanges, which is located above said lower flange, has a recess for at least partially receiving said one roller when said one roller overruns a mushroom-like boss formed on said strut at an end thereof remote from said stop.

9. A drawer guide for a pull-out component of a piece of furniture comprising:

a carcass rail fixedly attachable to an inner side of the piece of furniture and having a substantially C-shaped cross-section;

a support rail for supporting the pull-out component;

a substantially S-shaped middle rail arranged between said carcass and support rails and having at least two, arranged one above another, horizontal flanges which serve as tracks;

a plurality of freely rotatable rollers provided on said at least two horizontal flanges; and at least one stop provided between said middle and support rails for limiting a pull-out path therebetween, wherein one of the plurality of freely rotatable rollers is arranged at a rear end of said support rail, said stop cooperating with said one of the plurality of rollers for limiting the pull-out path;

wherein said stop projects through a recess formed in a lower one of said at least two horizontal flanges and is fixedly attached to a strut, which is formed of an elastically deformable material, extends in a longitudinal direction of said rails and has one end thereof arranged on said lower one of said two horizontal flanges, whereby said stop can be lowered beneath a plane of said lower one of said two flange;

wherein said strut has, at an end thereof remote from said stop, substantially mushroom-shaped boss, and said stop, said strut and said boss are formed of the elastically deformable material as a one-piece member.

* * * * *